United States Patent [19]

Novet

[11] Patent Number: 4,841,837

[45] Date of Patent: Jun. 27, 1989

[54] CRADLE OR BUCKET CHAIN FOR INFEEDING CARTRIDGES TO AN AUTOMATIC FIRING WEAPON

[75] Inventor: Hanspeter Novet, Volketswil, Switzerland

[73] Assignee: Werkzeugmaschinenfabrik Oerlikon-Bührle AG, Zürich, Switzerland

[21] Appl. No.: 4,577

[22] Filed: Jan. 20, 1987

[30] Foreign Application Priority Data

Jan. 22, 1986 [CH] Switzerland ..... 00239/86

[51] Int. Cl.[4] ..... F41D 10/06

[52] U.S. Cl. ..... 89/33.25; 89/35.01

[58] Field of Search ..... 89/33.16, 35.01, 33.25, 89/33.17, 35.02; 198/853; 221/84

[56] References Cited

U.S. PATENT DOCUMENTS

| | | | |
|---|---|---|---|
| 2,016,750 | 10/1935 | Mancini | 89/35.01 |
| 2,222,812 | 11/1940 | Faulkner et al. | 89/35.01 |
| 2,600,492 | 6/1952 | Dixon | 89/35.01 |
| 2,918,846 | 12/1959 | Porter | 89/35.01 |
| 3,720,301 | 3/1973 | Garland et al. | 89/33.16 |
| 3,800,937 | 4/1974 | Tassie | 89/35.01 |
| 4,114,511 | 9/1978 | Patenaude | 89/35.01 |
| 4,244,270 | 1/1981 | Tassie | 89/33.25 |
| 4,392,414 | 7/1983 | Koine | 89/35.01 |

FOREIGN PATENT DOCUMENTS

| | | | |
|---|---|---|---|
| 0152549 | 8/1985 | European Pat. Off. . | |
| 2114552 | 4/1974 | Fed. Rep. of Germany . | |
| 2443806 | 3/1975 | Fed. Rep. of Germany | 89/33.25 |
| 0355767 | 2/1930 | United Kingdom | 89/33.17 |

*Primary Examiner*—Deborah L. Kyle
*Assistant Examiner*—Stephen Johnson
*Attorney, Agent, or Firm*—Werner W. Kleeman

[57] ABSTRACT

A cradle or bucket chain of an ammunition conveyor system serves to deliver cartridges from an ammunition magazine through a cartridge infeed channel to an automatic firing weapon. The cradle chain is able to easily move through a markedly curved cartridge infeed channel. This cradle chain is constructed such that there is not needed a separate guide track or rail and such that the cartridges can be easily withdrawn from or cammed out of the cradle chain in the vicinity of the automatic firing weapon. For this purpose the individual cradle elements of the cradle chain are each provided with a cartridge infeed cam for infeeding the cartridges to the automatic firing weapon. Each cradle element further possesses a sword or tongue member projecting into a guide groove of the cartridge infeed channel. Additionally, each cradle element of the cradle chain is guided by means of two oppositely situated walls of the cartridge infeed channel.

5 Claims, 3 Drawing Sheets

CRADLE OR BUCKET CHAIN FOR INFEEDING CARTRIDGES TO AN AUTOMATIC FIRING WEAPON

BACKGROUND OF THE INVENTION

The present invention broadly relates to an ammunition conveyor system and, more particularly, pertains to a new and improved construction of a cradle or bucket chain for infeeding or delivering cartridges from a cartridge supply, such as an ammunition magazine or container, through a cartridge infeed channel to an automatic firing weapon.

Generally speaking, the cradle or bucket chain of the present invention comprises a plurality of cradle elements or cradle link elements which are hingedly connected to one another. Each cradle element comprises a cradle or bucket for accommodating or receiving a cartridge. Attached to each cradle element are at least two lugs or eyelets for connecting this cradle element with its neighboring cradle elements, i.e. with a leading or downstream cradle element and with a trailing or upstream cradle element as seen in the direction of travel of the cradle or bucket chain. Furthermore, guide or guiding means are attached to each cradle element to allow such cradle element to be slidingly guided within the cartridge infeed channel.

A known ammunition conveyor system for delivering cartridges from an ammunition magazine to an automatic firing weapon is disclosed in European Patent Publication No. 0,152,549, published Aug. 28, 1985. With this ammunition conveyor system there are arranged between the ammunition magazine and the automatic firing weapon a cartridge infeed or supply channel and a disk channel in which there is provided an endless conveyor chain guided on a guide rail extending from the ammunition magazine to the automatic firing weapon. This guide rail possesses a T-shaped groove into which projects a corresponding T-shaped projection of the conveyor chain. The conveyor chain is extensible and retractable to maintain small the acceleration forces required for the ammunition infeed at the beginning and at the end of a firing burst or operation.

This known conveyor or cradle chain has the disadvantage that, on the one hand, there are required complicated guide rails or tracks and, on the other hand, no means or facilities are provided to push or infeed the cartridges transported to the automatic firing weapon into such weapon.

SUMMARY OF THE INVENTION

Therefore, with the foregoing in mind it is a primary object of the present invention to provide a new and improved construction of an ammunition conveyor system, especially a cradle or bucket chain for infeeding cartridges or rounds into an automatic firing weapon, which does not exhibit the aforementioned drawbacks and shortcomings of the prior art constructions.

Another and more specific object of the present invention aims at providing a new and improved construction of a cradle or bucket chain for the infeed of cartridges to an automatic firing weapon, wherein no separate guide rails for guidance of the cradle or bucket chain in the cartridge infeed or supply channel are needed and in which no special means for withdrawal of the cartridges from the cradle or bucket chain are necessary and in which the cradle or bucket chain can easily traverse through the cartridge infeed or supply channel even if the latter is extensively curved.

Yet a further significant object of the present invention aims at providing a new and improved construction of an ammunition conveyor system containing a cradle or bucket chain which is relatively simple in construction and design, extremely economical to manufacture, highly reliable in operation, not readily subject to breakdown or malfunction and requires a minimum of maintenance and servicing.

Now in order to implement these and still further objects of the present invention which will become more readily apparent as the description proceeds the cradle or bucket chain of the present invention is manifested by the features that each cradle element of the cradle or bucket chain is provided with an infeed cam or cam means for infeeding or introducing the cartridges into the automatic firing weapon. Each cradle element possesses a protuberance in the form of, for instance, a sword member or tongue member projecting into a guide groove of a cartridge infeed channel. Moreover, each cradle element of the cradle or bucket chain is guided by two oppositely situated or mutually confronting walls of the cartridge infeed channel.

Preferably, the cartridge infeed cam or cam means of one cradle element, the sword or tongue member of its trailing cradle element and the common articulating pivot pin or bolt for these two neighboring cradle elements approximately lie in a plane extending transverse to the direction of travel of the cradle or bucket chain.

Furthermore, a respective eyelet or lug of one cradle element protrudes between two eyelets or lugs of a neighboring cradle element, and the interconnecting pivot pin or bolt extends through these three eyelets or lugs and is retained by a ball or spherical joint provided in the intermediate eyelet or lug. This pivot pin or bolt protrudes into elongate holes or openings of both of the outer situated eyelets or lugs.

The cradle or bucket chain according to the invention affords, among other things, the following notable advantages:

(a) The cradle or bucket chain can be guided without difficulty through a markedly curved cartridge infeed or supply channel, since the infeed cam or cam means of one cradle element, the protuberance, namely the sword or tongue member of the trailing cradle element and the common interlinking pivot pin or bolt approximately lie in a common plane disposed transverse to the direction of travel of the cradle or bucket chain.

(b) A special guide rail for the cradle or bucket chain is not required since the individual cradle elements or cradle link elements of the cradle or bucket chain are supported at two oppositely situated walls of the cartridge infeed channel and since the protuberance, namely the sword or tongue member of the cradle or bucket chain is guided within a guide groove of the cartridge infeed channel.

(c) The camming out or withdrawal of the cartridges from the individual cradles or buckets of the cradle or bucket chain in the vicinity of the automatic firing weapon is facilitated in that each cradle element possesses a cartridge infeed cam or cam means with the aid of which the cartridges can be positively extracted from the cradles or buckets and infed into the automatic firing weapon.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
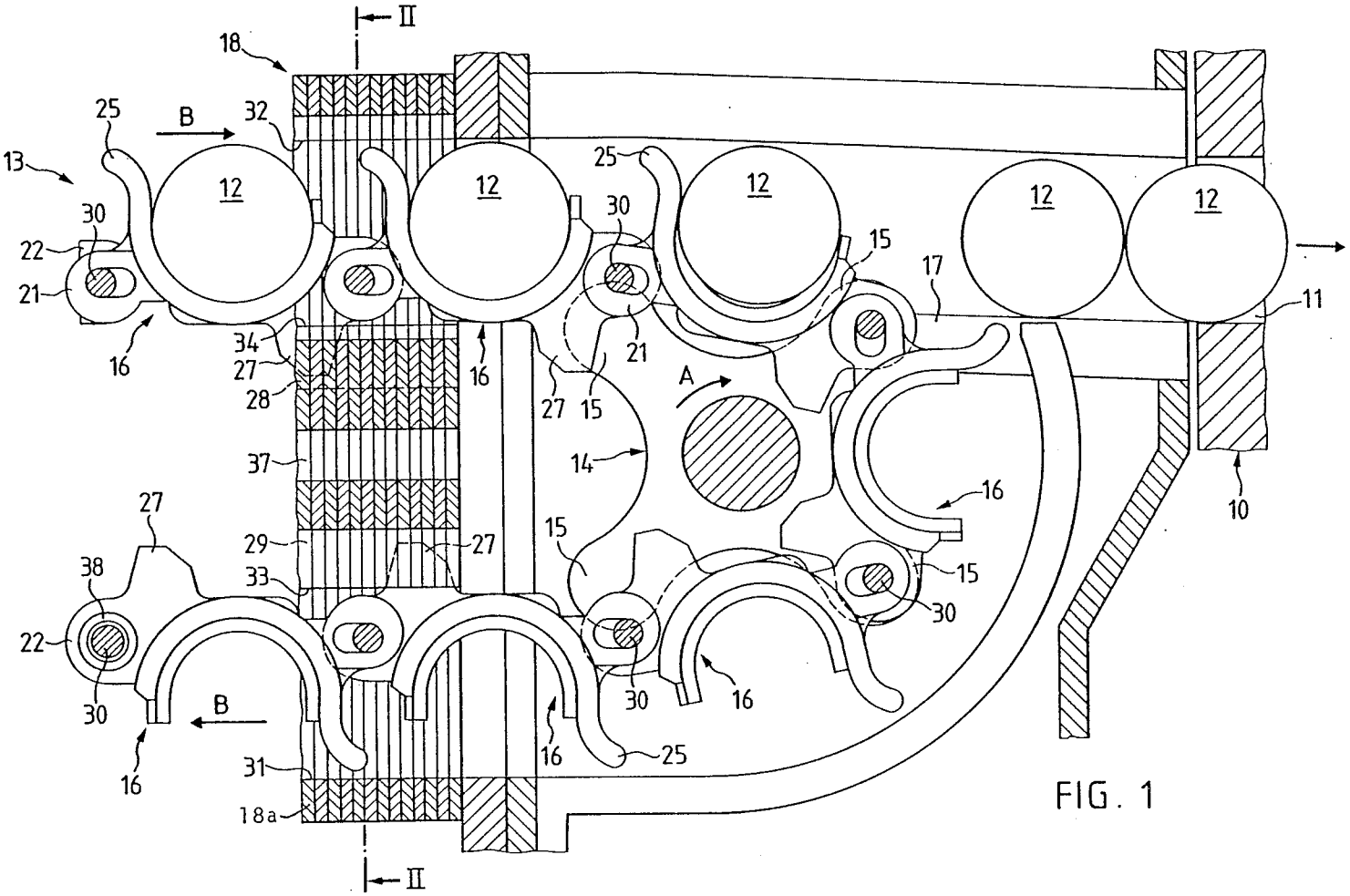
FIG. 1 shows a side elevational view, partially in section substantially taken along the line I—I in FIG. 2, of a cradle or bucket chain constructed according to the invention and located in the vicinity of an automatic firing weapon, wherein the cradle or bucket chain is trained over a deflection roll.

Describing now the drawings, it is to be understood that to simplify the showing thereof only enough of the structure of the inventive cradle or bucket chain 13 for an ammunition conveyor system has been illustrated therein as is needed to enable one skilled in the art to readily understand the underlying principles and concepts of the present invention. Turning now specifically to FIG. 1 of the drawings, the cradle or bucket chain 13 illustrated therein by way of example and not limitation will be understood to be depicted in detail at the vicinity of the automatic firing weapon, only part of which has been indicated by reference character 10. It will be understood, however, that the cradle or bucket chain 13 is composed of a plurality of interlinked cradle elements or cradle link elements 16 hingedly fastened or linked together so as to form the endless cradle or bucket chain 13 and the details of the individual cradle elements will be considered more fully in the following description. It is also to be understood that in FIG. 1 only the infeed opening 11 for the cartridges or rounds 12 of the automatic firing weapon 10 has been depicted and which are delivered to the automatic firing weapon 10 with the help of the cradle or bucket chain 13.

This cradle or bucket chain 13 is trained over a deflection roll or sprocket wheel 14 or equivalent structure which possesses four tooth members or teeth 15 which engage the cradle or bucket chain 13 between the individual cradle elements or cradle link elements 16. This deflection roll 14 rotates in the direction of arrow A and consequently the cradle or bucket chain 13 moves in the direction of arrow B so as to deliver the cartridges 12 from any suitable and thus not particularly illustrated ammunition magazine or supply to the automatic firing weapon 10. A guide rail or guide track 17 serves to aid in the withdrawal or camming out of the cartridges 12 from the individual cradle elements or cradle link elements 16 of the cradle or bucket chain 13 and guidance of the cartridges 12 towards and into the automatic firing weapon 10. The entire cradle or bucket chain 13 passes through a cartridge infeed channel or supply channel 18 constructed as, for instance, a disk or plate-type channel which, according to the showing of FIG. 2, possesses two openings or recesses 19 and 20. The cradle elements or cradle link elements 16 filled with the cartridges 12 move or pass through the upper opening or recess 20 and the empty cradle elements or cradle link elements 16 of the cradle or bucket chain 13 move or pass through the lower opening or recess 19 on their way back to the ammunition magazine.

Figure 2:
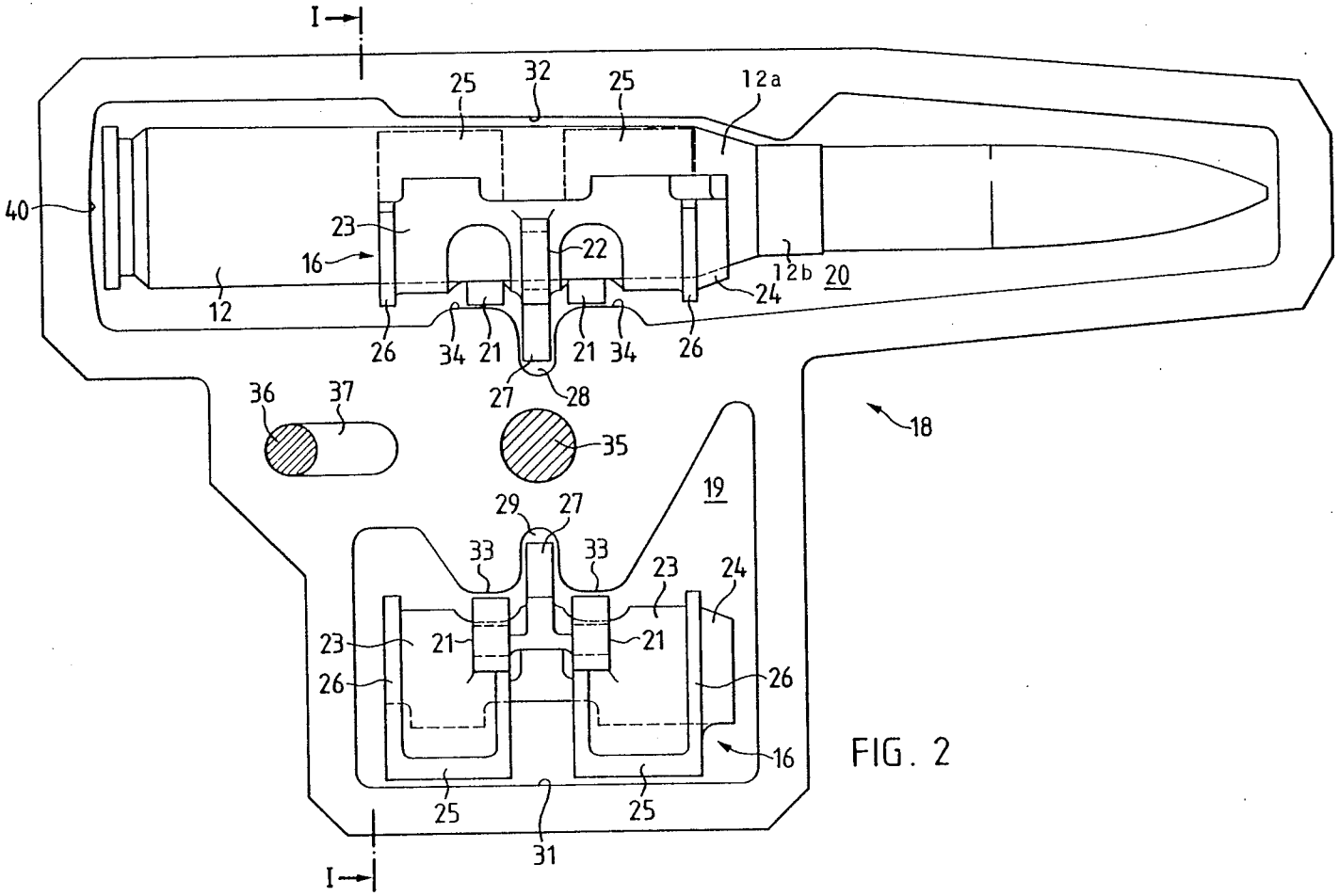
FIG. 2 shows a cross-section of the arrangement of FIG. 1, taken substantially along the line II—II thereof.
Figure 4:
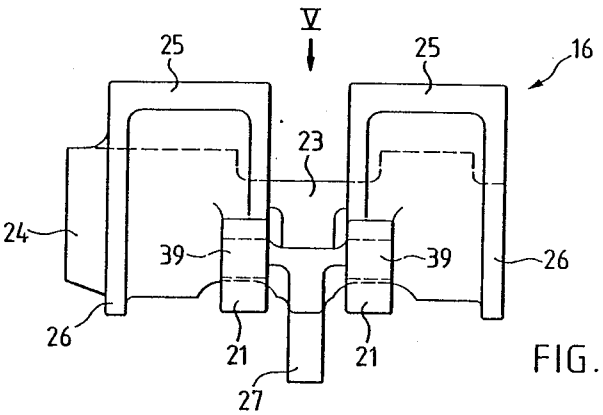
FIG. 4 shows the same cradle or bucket element as depicted in FIG. 3 in a view looking in the direction of the arrow IV in FIG. 3.
Figure 5:
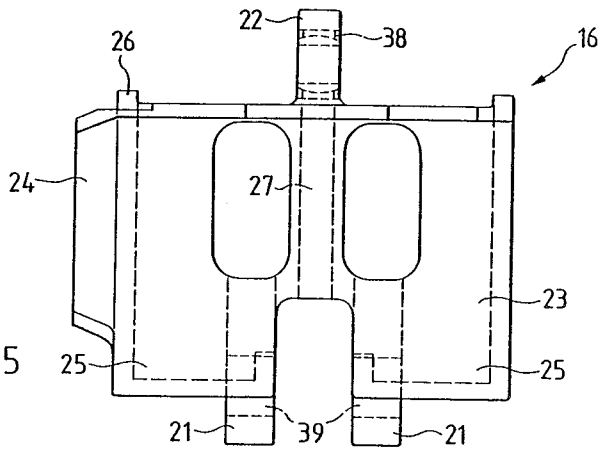
FIG. 5 shows a top plan view of the same cradle element of FIG. 3 as seen when looking in the direction of the arrow V in FIG. 4.
Figure 3:
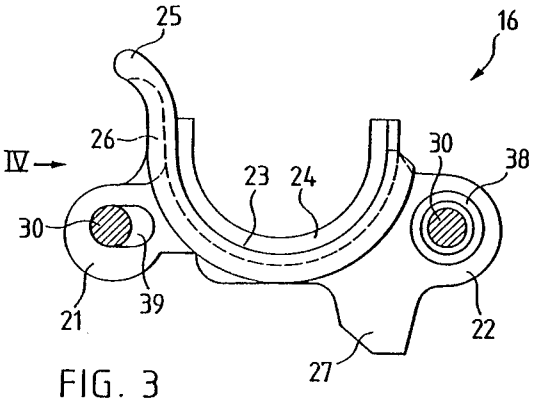
FIG. 3 shows a side view, partially in section, of an individual cradle or bucket element of the cradle or bucket chain.

Attention is now drawn to FIGS. 3, 4 and 5 where it will be observed that each cradle element or each cradle link element 16 of the cradle or bucket chain 13 possesses two first eyelets or lugs or lug structure 21 at which there is hingedly connected the neighboring upstream or trailing cradle element 16 viewed with respect to the direction of travel or movement B of the cradle or bucket chain 13 towards the automatic firing weapon 10. Each such cradle element or cradle link element 16 further possesses a second eyelet or lug 22 at which there is hingedly connected the neighboring downstream or leading cradle element 16. During the mutual articulation or linking of the individual cradle elements or cradle link elements 16 to form the cradle or bucket chain 13, the second eyelet or lug 22 of a given cradle element 16 is inserted between both first eyelets or lugs 21 of the immediately neighboring cradle element 16 as will be readily apparent by inspecting FIGS. 1 and 3 to 5. Between these eyelets or lugs 21 and 22 of any given cradle element 16 there is arranged the actual cradle or bucket 23 serving to accommodate or receive the associated cartridge or round 12. The front end of this cradle or bucket 23 possesses a collar 24 or equivalent structure against which bears a necked-down portion or shoulder **12*a* of a cartridge case 12*b* of the associated cartridge 12. This collar 24 prevents sliding out of the cartridge 12 from the front part of the relevant cradle or bucket 23. Furthermore, two cartridge infeed or supply cams or cam means 25 are connected to the cradle or bucket 23, the significance of which will be discussed hereinafter with reference to FIGS. 1 and 2. Additionally, a respective arcuate-shaped rib or bead 26 is provided at each oppositely situated end of the cradle or bucket 23. Finally, at the second eyelet or lug 22 there is arranged a protuberance in the form of a sword or tongue member 27 with the help of which the cradle or bucket chain 13 is guided in an appropriate guide groove or guide groove structure 28, 29 of the ammunition infeed or disk channel 18**.

According to the showing of FIGS. 1 and 2 the disk channel 18 comprises a plurality of disks **18*a* which are pivotably mounted on a common pivot shaft 35. In an elongated hole or opening 37 of the disk channel 18 there is guided a rod 36 which ensures uniform spreading or fanning of the individual disks 18*a* of the disk channel 18 during elevation of the automatic firing weapon 10**. Such type of disk channels are well known to the art and therefore need not here be further considered, particularly since details thereof beyond what is discussed in this disclosure are unimportant for understanding the underlying principles and concepts of the present invention.

As will be readily understood by inspecting FIG. 2, both of the infeed cams or cam means 25 of each cradle element 16 of the cradle or bucket chain 13 are supported by a guide surface 31 bonding one side of the opening or recess 19 of the disk channel 18 and by a guide surface 32 bounding the opening or recess 20 of the same disk channel 18, respectively. On the other hand, both of the first eyelets or lugs 21 are supported by respective guide surfaces 33 and 34 bounding the other opposite side of these openings or recesses 19 or 20 of the ammunition infeed or disk channel 18. As best seen by referring to FIG. 1, the cradle elements or cradle link elements 16 of the cradle or bucket chain 13 are thus guided by two oppositely situated guide surfaces 31 and 33 and 32 and 34, respectively, thus obviating the need for any additional guiding or guide rails.

According to FIG. 1 the individual cradle elements or cradle link elements 16 of the cradle or bucket chain 13 are pivotably connected to one another or hingedly interlinked by means of pivot pins or bolts 30. Each such pivot pin or bolt 30 is mounted in a ball or spherical joint 38 located in the associated eyelet or lug 22 (see FIG. 3) and extends into elongated holes or openings 39 provided in both eyelets or lugs 21 of the neighboring cradle element 16.

The mode of operation of the above-described cradle or bucket chain 13 for supplying or delivering cartridges from an ammunition magazine or storage to an automatic firing weapon while passing through the cartridge infeed channel or disk channel 18 is as follows:

According to FIG. 1, the pivot bolt or pin 30 interconnecting two neighboring cradle elements or cradle link elements 16 of the cradle or bucket chain 13 is positioned between the protuberance, namely the sword or tongue member 27 of one cradle element 16 and the cartridge infeed cam or cam means 25 of the other neighboring cradle element or cradle link element 16. Furthermore, from the showing of FIG. 1 it will be understood that the protuberance, namely the sword or tongue member 27 of the aforementioned one cradle element 16 and the cartridge infeed cam or cam means 25 of the other cradle element 16 as well as the interlinking or articulating pivot pin or bolt 30 for pivotably interconnecting these two neighboring cradle elements 16 are located approximately in a common plane which extends transversely with respect to the direction of movement B of the cradle or bucket chain 13. By virtue of this arrangement there is attained the beneficial result that the cradle or bucket chain 13 can reliably pass or traverse through a considerably curved cartridge infeed or disk channel 18 without the necessity of having to unfavorably increase the through-passage cross-section. The collar 24 arranged at each cradle or bucket 23 prevents undesirable sliding out or escape of the cartridge 12 from the cradle 23 in the direction of the tip of the cartridge 12, thereby preventing this sharp tip from impacting against the ammunition infeed or disk channel 18. This is necessary to preclude damage to the sharp tip or front end of the cartridge 12. On the other end, a guide surface 40 prevents sliding out or escape of the cartridge 12 in the opposite direction from the associated cradle or bucket 23 of the cradle or bucket chain 13. Furthermore, according to the illustration of FIG. 1, the infed or delivered cartridges or rounds 12 arrive at the guide rail or guide track 17 shortly before reaching the automatic firing weapon 10. Upon engagement with this guide rail 17 the cartridges or rounds 12 slide thereupon towards the infeed opening 11 of the automatic firing weapon 10, and the cartridge infeed cam or cam means 25 of each of the cradle elements 16 of the cradle or bucket chain 13 reliably infeed or introduce the cartridges or rounds 12 into the automatic firing weapon 10.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A cradle chain for delivering cartridges from an ammunition magazine, by means of a cartridge infeed channel having two oppositely situated walls and provided with guide groove means, to an automatic firing weapon, comprising:

a plurality of interlinked cradle elements;

each cradle element of said plurality of interlinked cradle elements comprising:

a cradle for accommodating a cartridge;

at least two lug means attached to said cradle for connecting said cradle element with a leading cradle element and with a trailing cradle element as seen in a predetermined direction of travel of said plurality of cradle elements;

infeed cam means of said cradle directly acting upon said cartridge for infeeding the cartridge into the automatic firing weapon;

a sword member projecting into the guide groove means of said cartridge infeed channel;

means for pivotably interconnecting two immediately neighboring cradle elements with one another and coacting with said lug means of said two neighboring cradle elements, which lug means interfit with one another;

said at least two lug means and said infeed cam means being located on two opposite sides of said cradle;

said cradle being guided on a first one of its two opposite sides at one of the oppositely situated walls of the cartridge infeed channel by said infeed cam means during movement of said cradle through said cartridges infeed channel; and said cradle being guided on a second one of its two opposite sides at an other one of the oppositely situated walls of the cartridge infeed channel by one of said at least two lug means during the movement of said cradle through said cartridge infeed channel.

2. The cradle chain as defined in claim 1, wherein:

said first and second opposite sides of the cradle respectively constitute a top side and a bottom side;

said infeed cam means protruding beyond said top side of said cradle;

said top side of said cradle being confronted by said one wall of said two oppositely situated walls of said cartridge infeed channel; and said bottom side of said cradle being confronted by said other wall of said two oppositely situated walls of said cartridge infeed channel.

3. The cradle chain as defined in claim 1, wherein:

said cradle defines an upstream side and a downstream side as viewed in the direction of travel of the cradle through said cartridge infeed channel; and said infeed cam means and said one lug means being located on the upstream side of said cradle.

4. The cradle chain as defined in claim 3, wherein:

said at least two lug means containing an other lug means located at the downstream side of said cradle;

said other lug means containing a ball joint;

a pivot pin held by said ball joint;

said pivot pin interlinking said other lug means of said cradle and said one lug means of a neighboring downstream located cradle in the cradle chain; and said one lug means containing an elongated hole for receiving said pivot pin.

5. The cradle chain as defined in claim 4, wherein: said sword member protruding beyond a bottom side of said cradle in a region of said other lug means.

* * * * *

UNITED STATES PATENT AND TRADEMARK OFFICE

CERTIFICATE OF CORRECTION

PATENT NO. : 4,841,837

DATED : June 27, 1989

INVENTOR(S) : HANSPETER NOVET

It is certified that error appears in the above-identified patent and that said Letters Patent is hereby corrected as shown below:

Column 4, line 67, after "31" please delete "bonding" and insert --bounding--

Column 6, line 38, after "said" please delete "cartridges" and insert --cartridge--

Signed and Sealed this

Tenth Day of April, 1990

*Attest:*

HARRY F. MANBECK, JR.

*Attesting Officer*

*Commissioner of Patents and Trademarks*